US005720647A

United States Patent [19]

Gottschald

[11] Patent Number: 5,720,647

[45] Date of Patent: Feb. 24, 1998

[54] DEVICE FOR MOUNTING A RETAINING PART ON AN OPTICAL SURFACE OF AN OPHTHALMIC BLANK

[75] Inventor: Lutz Gottschald, Meerbusch, Germany

[73] Assignee: Wernicke & Co. GmbH, Germany

[21] Appl. No.: 603,807

[22] Filed: Feb. 20, 1996

[30] Foreign Application Priority Data

Feb. 18, 1995 [DE] Germany ..... 194 095 524.1

[51] Int. Cl.[6] ..... B24B 49/00

[52] U.S. Cl. ..... 451/5; 451/460; 451/390; 451/42; 269/21

[58] Field of Search ..... 269/21, 58, 71, 269/55, 909; 451/460, 390, 384, 42, 5, 332, 333

[56] References Cited

U.S. PATENT DOCUMENTS

| | | | |
|---|---|---|---|
| 4,088,312 | 5/1978 | Frosch et al. | 269/21 |
| 4,229,911 | 10/1980 | Bicskei | 451/460 |
| 4,543,752 | 10/1985 | Kotting | 451/460 |
| 4,684,113 | 8/1987 | Douglas et al. | 269/21 |
| 4,715,775 | 12/1987 | Amino | 269/71 |
| 4,829,716 | 5/1989 | Ueda et al. | 451/333 |
| 5,005,633 | 4/1991 | Mathews et al. | 269/58 |
| 5,070,657 | 12/1991 | Brule et al. | 451/390 |
| 5,138,798 | 8/1992 | Volat | 451/42 |
| 5,209,026 | 5/1993 | Cariou et al. | 451/390 |
| 5,263,285 | 11/1993 | Langlois et al. | 451/390 |
| 5,498,200 | 3/1996 | Werner | 451/390 |
| 5,505,654 | 4/1996 | Wood et al. | 451/5 |
| 5,588,899 | 12/1996 | Gottschald | 451/5 |

FOREIGN PATENT DOCUMENTS

| | | |
|---|---|---|
| 0431711 | 12/1991 | European Pat. Off. . |
| 3220310 | 12/1982 | Germany . |
| 4233400 | 5/1994 | Germany . |
| 4431880 | 3/1995 | Germany . |

*Primary Examiner*—Eileen Morgan
*Attorney, Agent, or Firm*—Ostrolenk, Faber, Gerb & Soffen, LLP

[57] ABSTRACT

A device for mounting a retaining part on an optical surface of an ophthalmic blank, e.g., before the insertion of the ophthalmic blank into an ophthalmic glass processing machine. The device has at least one viewing unit for parallax-free centering of the ophthalmic blank, at least one retaining device for supporting the ophthalmic blank during centering, and a motion drive for the retaining device for moving the ophthalmic blank from the centering position at the viewing device into a position for mounting the retaining part.

26 Claims, 8 Drawing Sheets

DEVICE FOR MOUNTING A RETAINING PART ON AN OPTICAL SURFACE OF AN OPHTHALMIC BLANK

BACKGROUND OF THE INVENTION

The invention relates to a device for mounting a retaining part on a first optical surface of an ophthalmic blank before the ophthalmic blank is inserted into an ophthalmic glass processing machine.

Such retaining parts are required if the second or the other optical surface of an ophthalmic blank is to be processed in accordance with the required optical values, or if the circumference of the ophthalmic glass is to be rimmed in accordance with the shape of a selected spectacle frame.

In order to process the second optical surface of an ophthalmic blank, the retaining part must be mounted on an already completely processed first optical surface of the ophthalmic blank in a manner which takes account of a prescribable preliminary decentering, the position of a reading area, and the axial position of a cylindrical or prismatic cut. A similar condition also applies in the case of mounting a retaining part for the rimming of the ophthalmic blank. Here it is additionally necessary to take account of the decentering, that is the positions of the pupils of the wearer with reference to the geometric center point of the ophthalmic glass openings of the spectacle frame which the spectacle wearer has chosen.

German Patent 42 33 400 from the assignee hereof describes a device for parallax free centering of an ophthalmic blank and for applying markings and/or for mounting a retaining part before an ophthalmic blank is inserted into an ophthalmic glass rim grinding machine. The device includes a beam splitter arranged between the eye and the ophthalmic blank to superimpose on the image of the ophthalmic blank an image of a template or of a spectacle frame opening and of a scale. This device has a bearing which is driven by an electric motor and which can be moved up and down. A blank holder can likewise be moved up and down and it holds the ophthalmic blank on the bearing but permits lateral movements in the bearing plane. A proximity detector, which is operationally connected to the drive for the bearing and to the blank holder, positions the ophthalmic blank at a predeterminable height while the blank is held between the blank holder and the bearing. The retaining part to be mounted on the ophthalmic blank is mounted on a holder of a pivoted arm, which can be pivoted out and can be pivoted into the region of the centered ophthalmic blank that is held between the bearing and the blank holder. As a result, the bearing is moved upward with the ophthalmic blank and the blank holder until the top side of the ophthalmic blank bears against the retaining part and adheres to it. This retaining part can be configured as a sucker or an adhesive block. Thereafter, the ophthalmic blank with the retaining part fastened to it is removed from the device and inserted into an ophthalmic glass rim grinding machine. This known device can be used to mount exclusively prefabricated adhesive blocks or suckers of small diameter on the ophthalmic blank.

U.S. patent application Ser. No. 08/117,733, filed Sep. 7, 1993, describes a further device for mounting a retaining part on one optical surface of an ophthalmic blank before it is inserted into a machine for processing the second optical surface. The ophthalmic blank is laid with its convexly curved first optical surface onto an alignment retaining ring that is arranged above a flat LCD screen. The screen shows images of the finished, rimmed ophthalmic glass, a reticle and further data required for processing the ophthalmic glass. The ophthalmic blank laid onto this fixed alignment retaining ring is viewed using a viewing unit and the blank can be displaced by hand into a desired or prescribed centering position. Thereafter a retaining device in the form of a sucker is lowered onto the surface of the ophthalmic blank to be processed and transports the ophthalmic blank in the transverse direction to a device for casting a plastic retaining part onto the optical surface of the ophthalmic blank. The ophthalmic blank is deposited by the retaining device onto a sealing ring and is provided from below with the retaining part. This is performed such that there is first inserted into a cavity below the sealing ring an element of the retaining part which is configured in accordance with a receptacle in a machine for processing the optical surface. Then the interspace between this element of the retaining part and the optical surface of the ophthalmic blank is filled with a thermoplastic material.

SUMMARY OF THE INVENTION

It is an object of the present invention to provide a device for mounting a retaining part on an optical surface of an ophthalmic blank, by which all types of retaining parts can be mounted, and which permits the mounting of always similar retaining parts in conjunction with a simple design and simple mode of operation, even if the ophthalmic blank is to be given or has a prismatic or cylindrical cut.

A device of the type mentioned above has at least one viewing unit with a fixed stop against which the ophthalmic blank is to be laid and the viewing unit enables parallax free viewing while centering the ophthalmic blank. There is at least one movable retaining device with a bearing for the ophthalmic blank. At least one block station is arranged in a plane below or above the movable retaining device. A motion drive for the retaining device lays the ophthalmic blank held on the bearing against the stop into the centering position and from the centering position into a position, arranged therebelow or to the side thereof, for mounting the retaining part in the at least one block station.

In contrast with the device in German Patent 42 33 400, the position for mounting the retaining part is not situated between the viewing unit and the retaining device and above the centering position. It is instead arranged below or to the side of the centering position. As a result, it is possible to provide a fixed stop on the viewing unit which is intended exclusively for centering, but which has no function during mounting of the retaining part. The stop can therefore be configured as a simple, stable ring, possibly with three pins arranged uniformly around the ring opening. As a result, an always constant viewing plane is defined for the ophthalmic blank, independently of how the ophthalmic blank is aligned or centered.

If only one position for mounting the retaining part is located below the retaining device, it is only necessary for the retaining device to be capable of being moved up and down between the centering position and the position for mounting the retaining part and also of being pivoted about a horizontal axis.

However, the retaining device can be advantageously displaced transversely between a first and a second position for mounting the retaining part, making it respectively possible to center an ophthalmic blank and to provide a retaining part to a second, already centered ophthalmic blank which is in the second position.

This can be achieved, for example, because two retaining devices are arranged kinetically coupled next to one another and can be moved alternately into the centering position and the respective position for mounting the retaining part. It is possible for the centering position to be situated approximately centrally between the two positions for mounting the retaining part.

It is likewise possible to arrange two retaining devices in respective positions each for mounting the retaining part, and to arrange the viewing unit so that it is capable of moving transversely into each region of a respective retaining device.

It is, however, also possible to arrange a retaining device capable of moving alternately into one of two positions for mounting the retaining part, and to provide a viewing unit in each of the two positions.

Finally, it is also further possible to arrange a retaining device and a viewing device kinetically coupled and capable of being moved alternately into one of two positions for mounting the retaining part.

The motion drive for the retaining device may be used to raise and/or lower the device, respectively as far as the stop on the viewing unit and/or into the position for mounting the retaining part.

If the position for mounting the retaining part is situated below the retaining device, the latter can have a pivot drive about a horizontal axis, causing the ophthalmic blank received by the retaining device to be pivoted upward in order to be brought into the centering position and to then be pivoted downward in order to be brought into the position for mounting the retaining part.

It is preferable for the retaining device to have three bearing pins with controllable suction heads for holding the ophthalmic blank on the surface opposite the optical surface. After alignment or centering of the ophthalmic blank, vacuum is applied to the suction heads, for securing the ophthalmic blank in place so that during the process, the circumference and the already processed optical surface remain completely free.

If the bearing pins are arranged to be axially displaceable in a resilient fashion, the optical surface of the ophthalmic blank always makes contact with the stop over its entire area in the centering position, and the ophthalmic blank can always be aligned without any problem.

The retaining device can advantageously comprise a pot shaped carrier with an illuminating system and guides for the bearing pins. The pins penetrate a ground glass screen and a condenser lens, and there can be a locking device for the bearing pins. This locking device holds the bearing pins in place in the position which they assume upon centering of the ophthalmic blank. As a result, the ophthalmic blank can be moved in this position into the position for mounting the retaining part.

Preferably, the viewing unit, the stop and the retaining device can be arranged one above another on a common carriage, and the carriage can be moved on a carrier housing alternately into one or the other of the two positions for mounting the retaining part.

In one embodiment, in order to be able both to move the retaining device up and down and to pivot it about a horizontal axis, the retaining device has axially parallel guide rails. These cooperate with corresponding complementary guide rails which are, pivotable about a horizontal axis, on parallel retaining arms of the carriage. This enables the retaining device to be pivoted and raised and lowered between the centering position with an upwardly directed optical surface of the ophthalmic blank and the position for mounting the retaining part with an obliquely downwardly directed optical surface of the ophthalmic blank.

Preferably, a device for casting on a wax, plastic or metal alloy retaining part can be arranged in the position(s) for mounting the retaining part on the optical surface of the centered ophthalmic blank.

Other features and advantages of the present invention will become apparent from the following description of the exemplary embodiments of the invention which refers to the accompanying drawings.

DETAILED DESCRIPTION OF THE INVENTION

Figure 1:
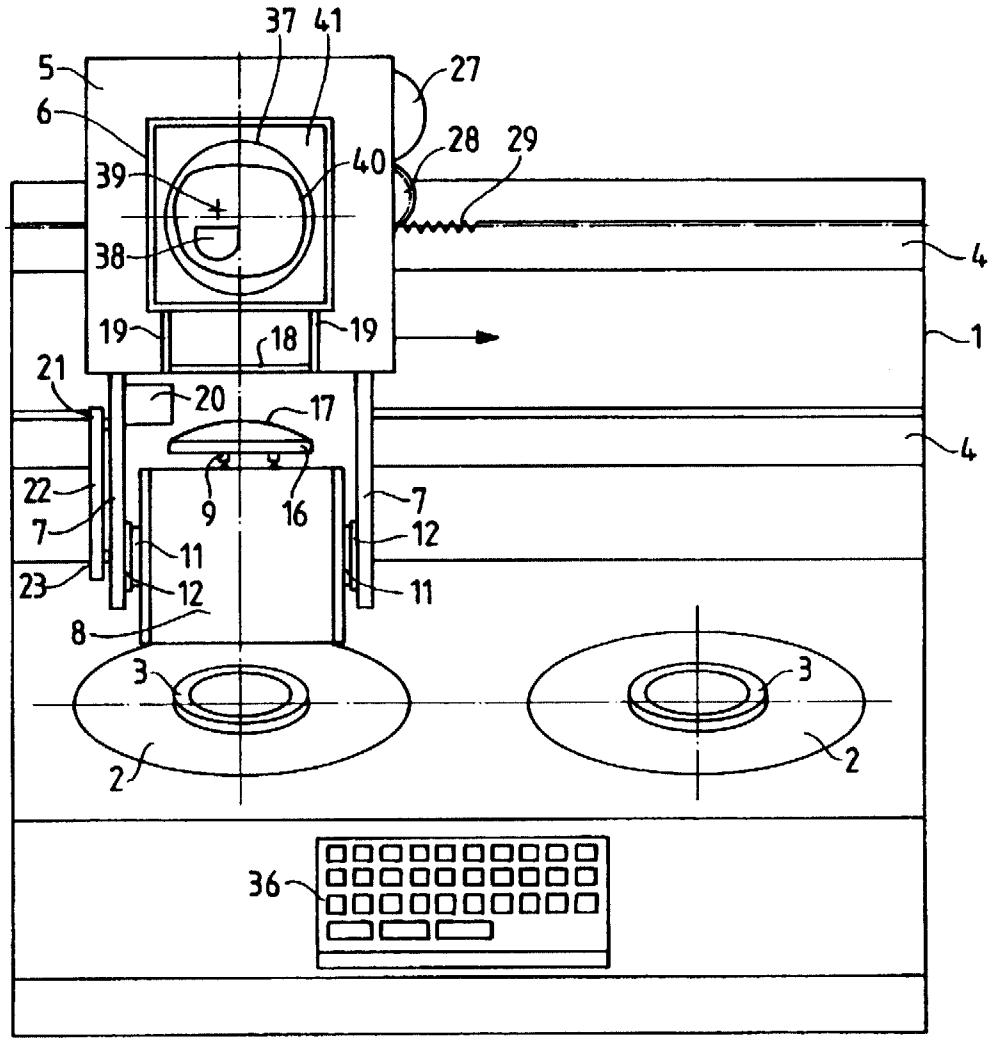
FIG. 1 shows a front view of a first embodiment of the device.

In the exemplary embodiment in accordance with FIGS. 1 to 8, the device has a carrier housing 1 with a bevelled front surface on which are arranged two spaced apart block stations 2. Each has a central sealing ring 3. An arrangement (not represented in detail) is located in the carrier housing 1 below the block stations 2 for retaining liquid state wax, thermoplastic material or a metal alloy. When an ophthalmic blank 16 is placed onto the sealing ring 3, the above noted material can be inserted into a mold cavity below the ophthalmic blank on the sealing ring 3 and can then be cooled there.

Two parallel guide rails 4 are arranged on a perpendicular or upstanding surface of the carrier housing 1. A carriage 5 can be transversely displaced along those rails. The displacement can be caused by a geared motor 27 which is fastened on the carriage 5 and engages a gear wheel 28 which in turn meshes with a gear rack 29 on one of the guide rails 4.

A viewing unit 6 is arranged on the carriage 5. Its optical part can correspond to the viewing unit described in German Patent 42 32 400. Moreover, parallel retaining arms 7 are arranged on the carriage 5 and extend approximately horizontally and parallel to the viewing unit 6 and out from the housing 1. A pot shaped carrier 8 is arranged on the end of the retaining arms 7. Three resilient, axially displaceable bearing pins 9 project from one side of the carrier 8. Suction heads 10 are arranged on the ends of the pins 9.

Figure 7:
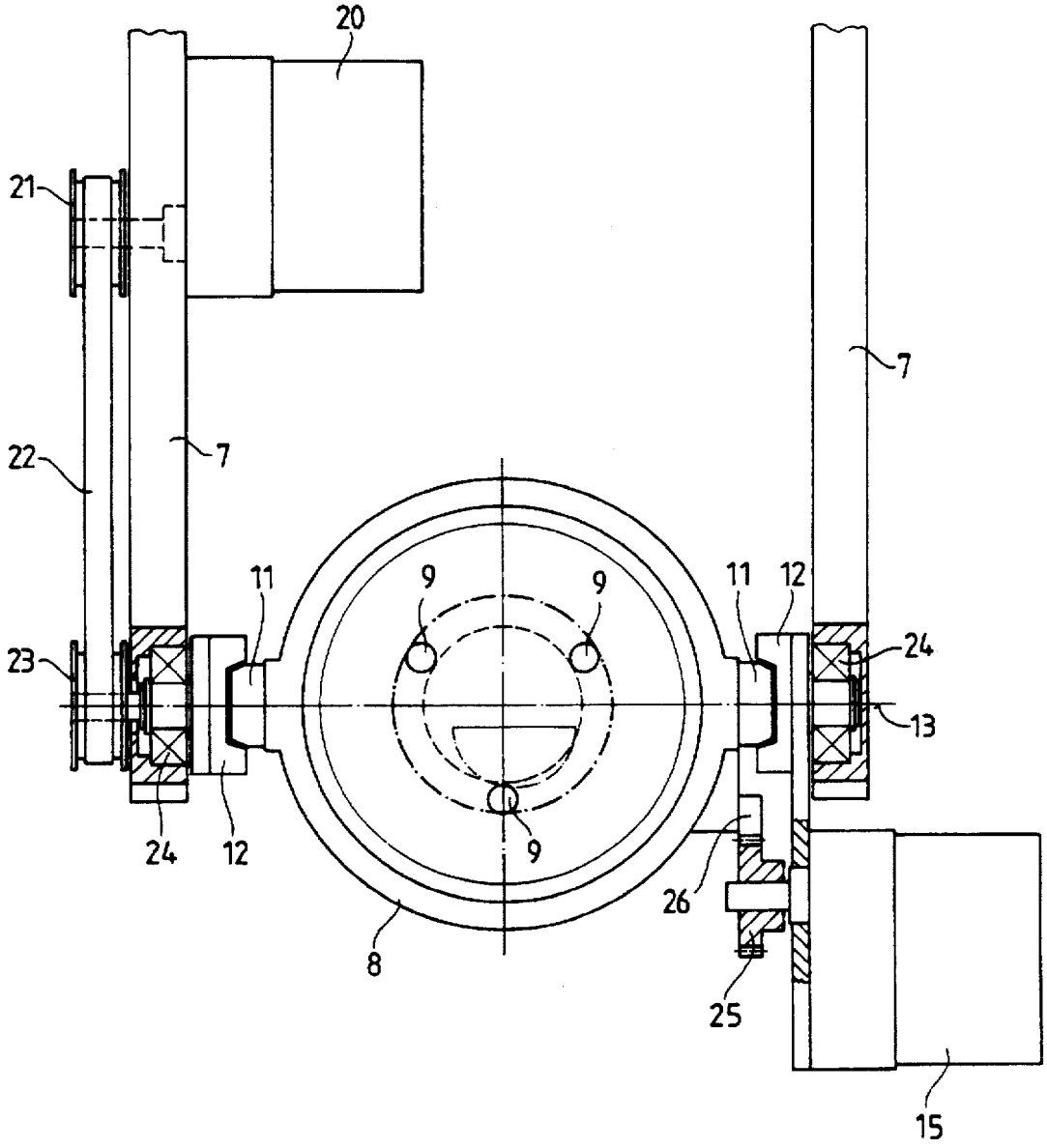
FIG. 7 shows a detailed plan view of the retaining part.

As can be seen in FIG. 7, axially parallel guide rails 11 are fastened at the side of the pot shaped carrier 8. The rails 11 cooperate with corresponding complementary guide rails 12 on the retaining arms 7. The guide rails 12 are pivotable about a horizontal pivot axis 13 extending parallel to the guide rails 4. For this purpose, the guide rails 12 are mounted in the respective retaining arms 7 with the aid of ball bearings 24 and are connected to a pivot drive 14 and to a height adjusting drive 15. The pivot drive comprises a geared motor 20, which is mounted on a pivotable arm 7, through a toothed belt wheel 21. A further toothed belt wheel 23 is arranged at the pivot axis 13 of the guide rails 12. A toothed belt 22 is trained over the toothed belt wheels 21, 23. The height adjusting drive 15 comprises a geared motor which is fastened to one of the guide rails 12 and which has a gear wheel 25 that meshes with a gear rack 26 on the respective guide rail 11.

Figure 2:
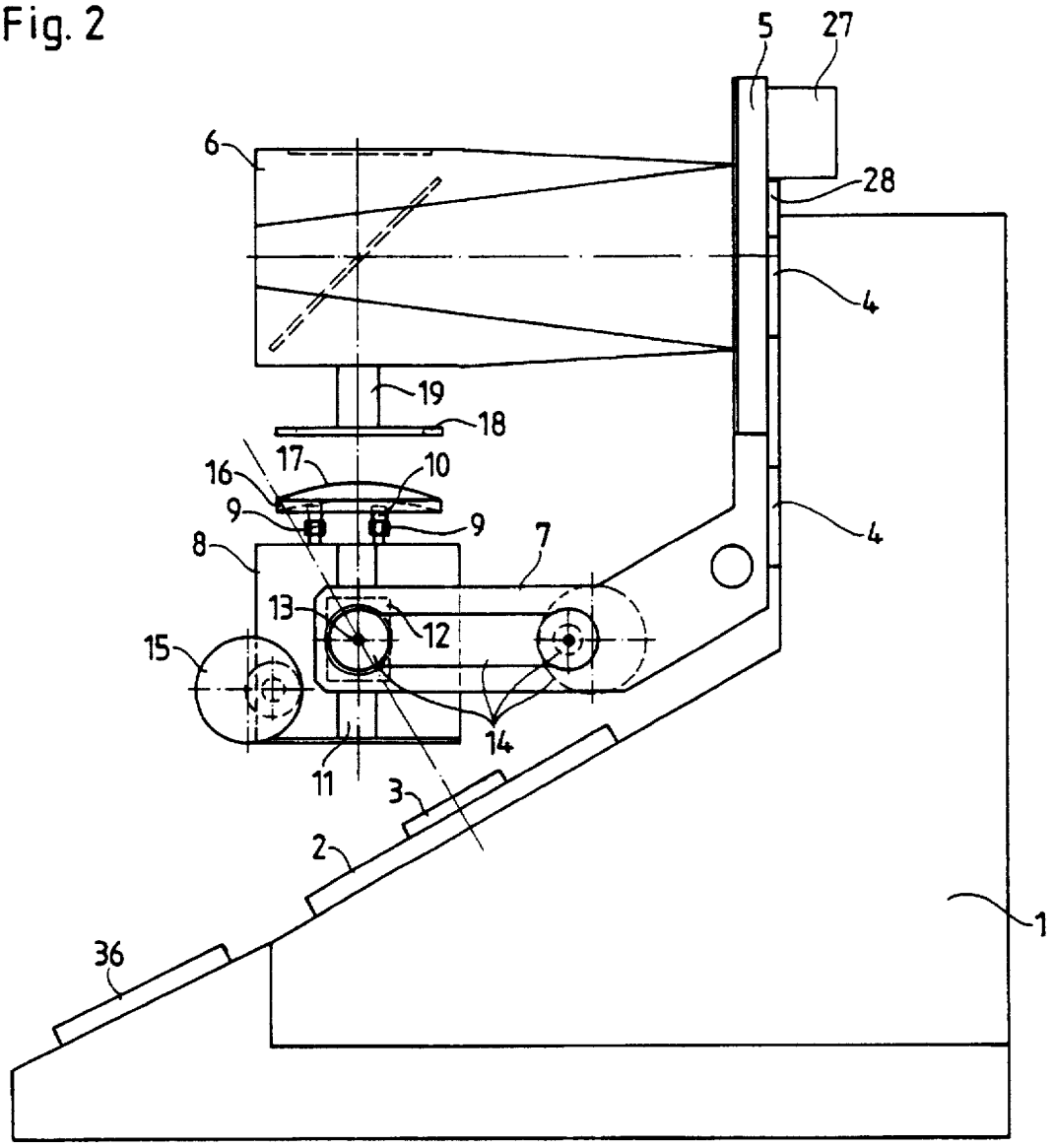
FIG. 2 shows a side view of the device in FIG. 1.

In the operating position represented in FIGS. 1 and 2, an ophthalmic blank 16 can be laid onto the suction heads 10 of the bearing pins 9 such that one finally processed optical surface 17 of the ophthalmic blank 16 is directed toward the viewing unit 6. Thereafter, the pot shaped carrier 8, with the bearing pins 9 and the ophthalmic blank 16 laid onto the suction heads 10 is moved up into the position shown in FIG. 3, in which the optical surface 17 contacts an annular stop 18 and is positioned by means of holders 19 on the viewing unit 6. In this operating position, the ophthalmic blank 16 is located in a plane which is defined by the stop ring 18 and at which parallax free viewing of a display screen 41 of the viewing unit is possible. An image 37 of the ophthalmic blank appears on the display screen 41, and a close up viewing area 38 possibly already present can likewise be seen. The display screen is preferably configured as a transparent LCD screen. It is also possible to image an image of the rimmed ophthalmic glass 40 on the display screen 41, as well as to represent the position of the possibly decentered optical center point 39, the axial position of a prismatic and/or a cylindrical cut. It is also possible to mark a preliminary decentering, in order to be able to produce, with as small as possible a diameter of the ophthalmic blank, a specific ophthalmic glass corresponding to the shape of a selected spectacle frame and with the personal optical values of the spectacle wearer. The different optical values can be input by means of an input keyboard 36 for a conventional control unit (not represented in detail) or in another known way, for example by a bar code reader or a diskette.

Figure 8:
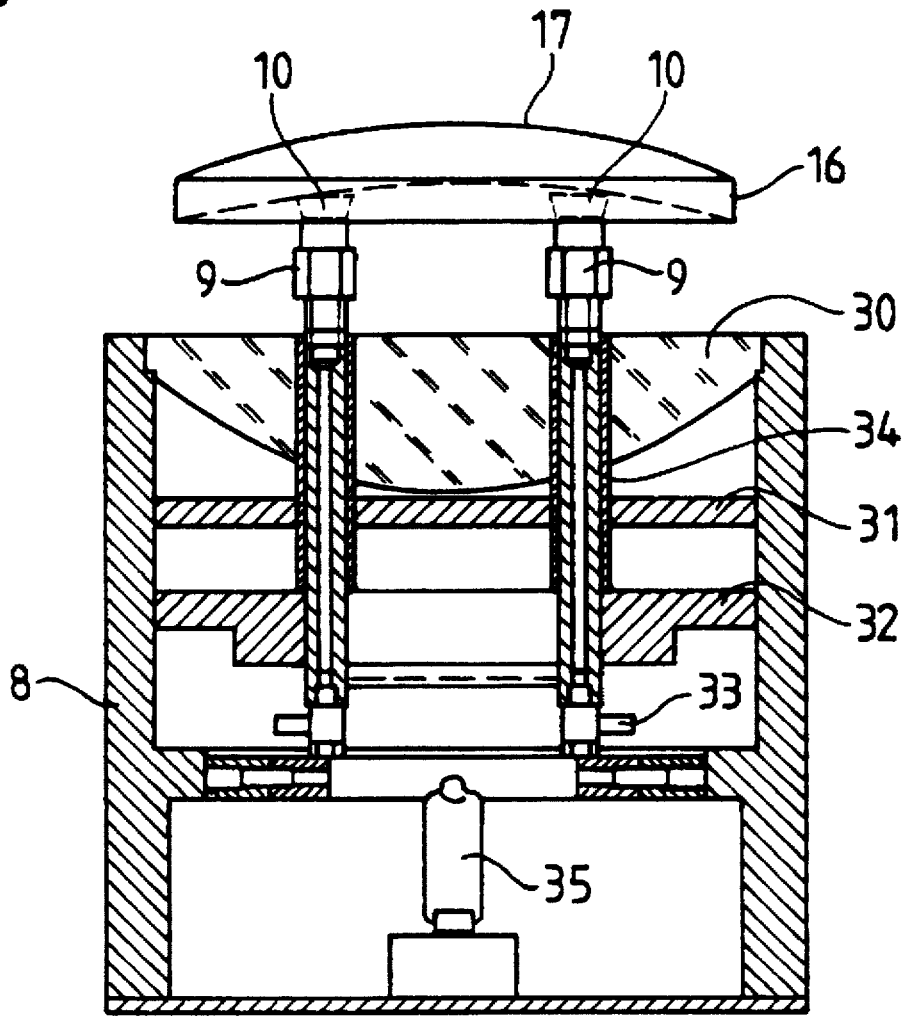
FIG. 8 shows a sectional view of the retaining part.

As seen in FIG. 8, the pot shaped carrier 8 has on its upper surface a condenser lens 30. A ground glass screen 31 is below the lens. Guide sleeves 34 for the resiliently axially displaceable bearing pins 9 extend through the condenser lens 30 and the ground glass screen 31.

Each bearing pin 9 is provided with a vacuum or suction connection 33 to apply vacuum to the suction heads 10.

Figure 3:
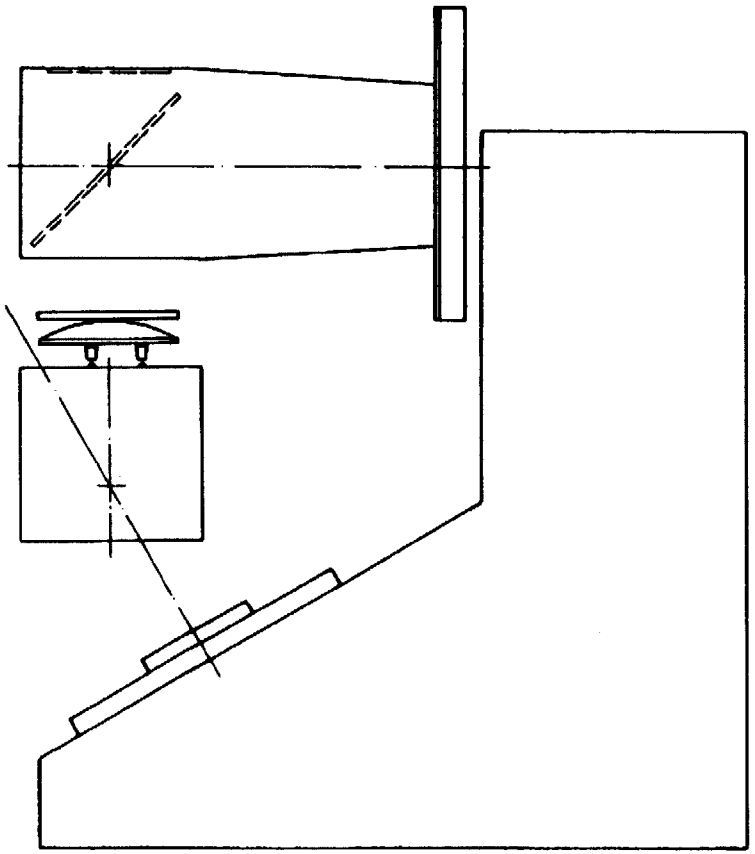
Figure 6:
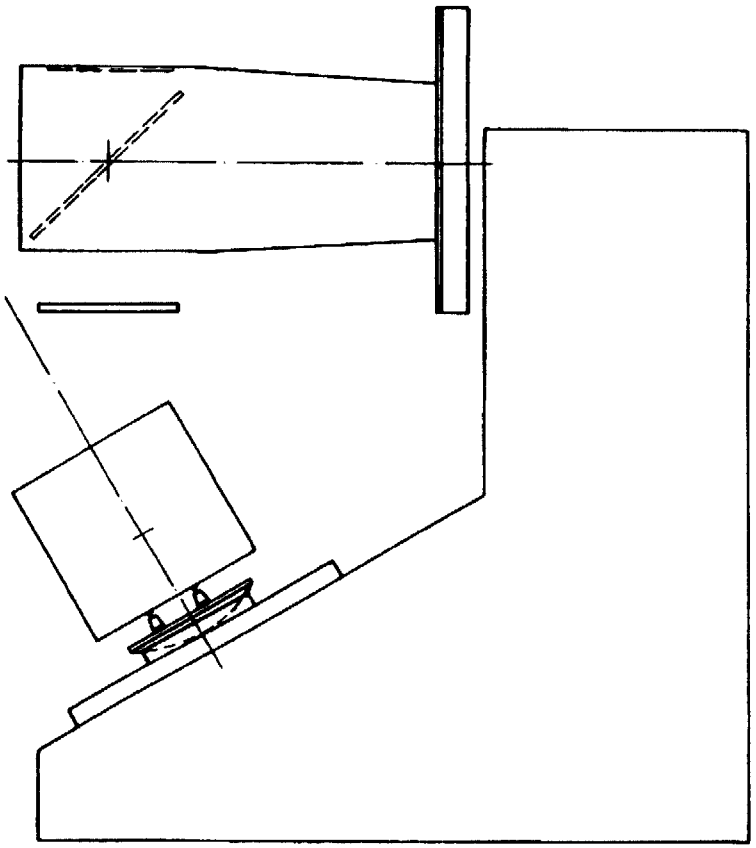
Figure 5:
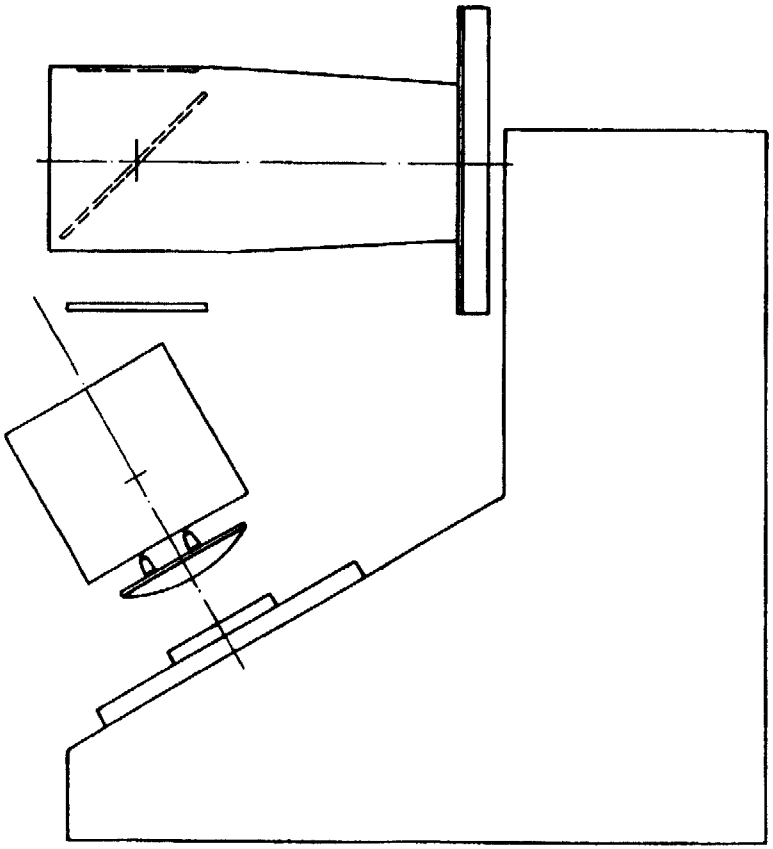

Referring to FIG. 7, after the ophthalmic blank has been aligned and centered in the position shown in FIG. 3, a clamping ring 32 is actuated. Vacuum is applied to the underside of the ophthalmic blank 16 via the vacuum connections 33. The blank 16 is held in place in the position specified in the centering position. An incandescent lamp 35 arranged in the pot shaped carrier 8 illuminates the ophthalmic blank 16 through the ground glass screen 31 and the condenser lens 30 in such a way that the ophthalmic blank is clearly visible, including a close up viewing area, which is possibly present, on the display screen 41 of the viewing unit 6.

Figure 4:
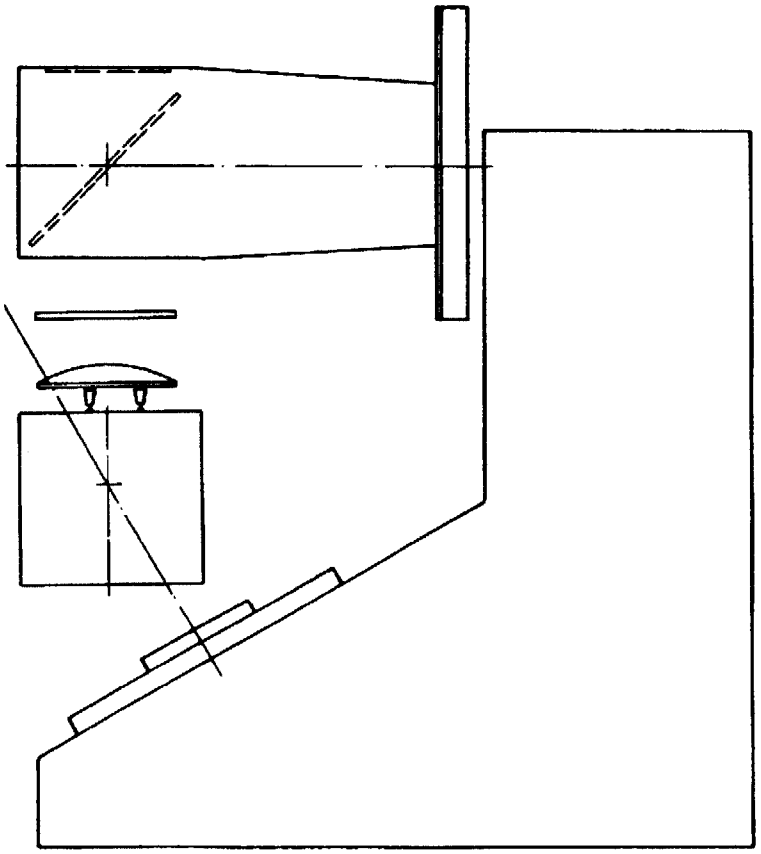
FIGS. 3 to 6 show the different positions of the retaining part from the centering position as far as the position for mounting a retaining part.

After the blank is centered, the pot shaped carrier 8 is lowered into the position shown in FIG. 4 by actuating the height adjusting drive 15. The carrier is subsequently pivoted into the position shown in FIG. 5 by actuating the pivot drive 14, and it is lowered into the position shown in FIG. 6 by renewed actuation of the height adjusting drive 15. As a result, the ophthalmic blank 16 is held sealed off on the sealing ring 3 together with its optical surface 17. In this position, wax, or thermoplastic material or a metal alloy is inserted into the cavity below the ophthalmic blank 16 and between the sealing ring 3 where that material cools down.

During the cool time, the carriage 5 can already be moved with the viewing unit 6 and the retaining device, comprising the pot-shaped carrier 8, the bearing pins 9 and the suction heads 10, transversely into the region of the second block station 2, where the same operation of centering and mounting a retaining part can proceed.

Figure 9:
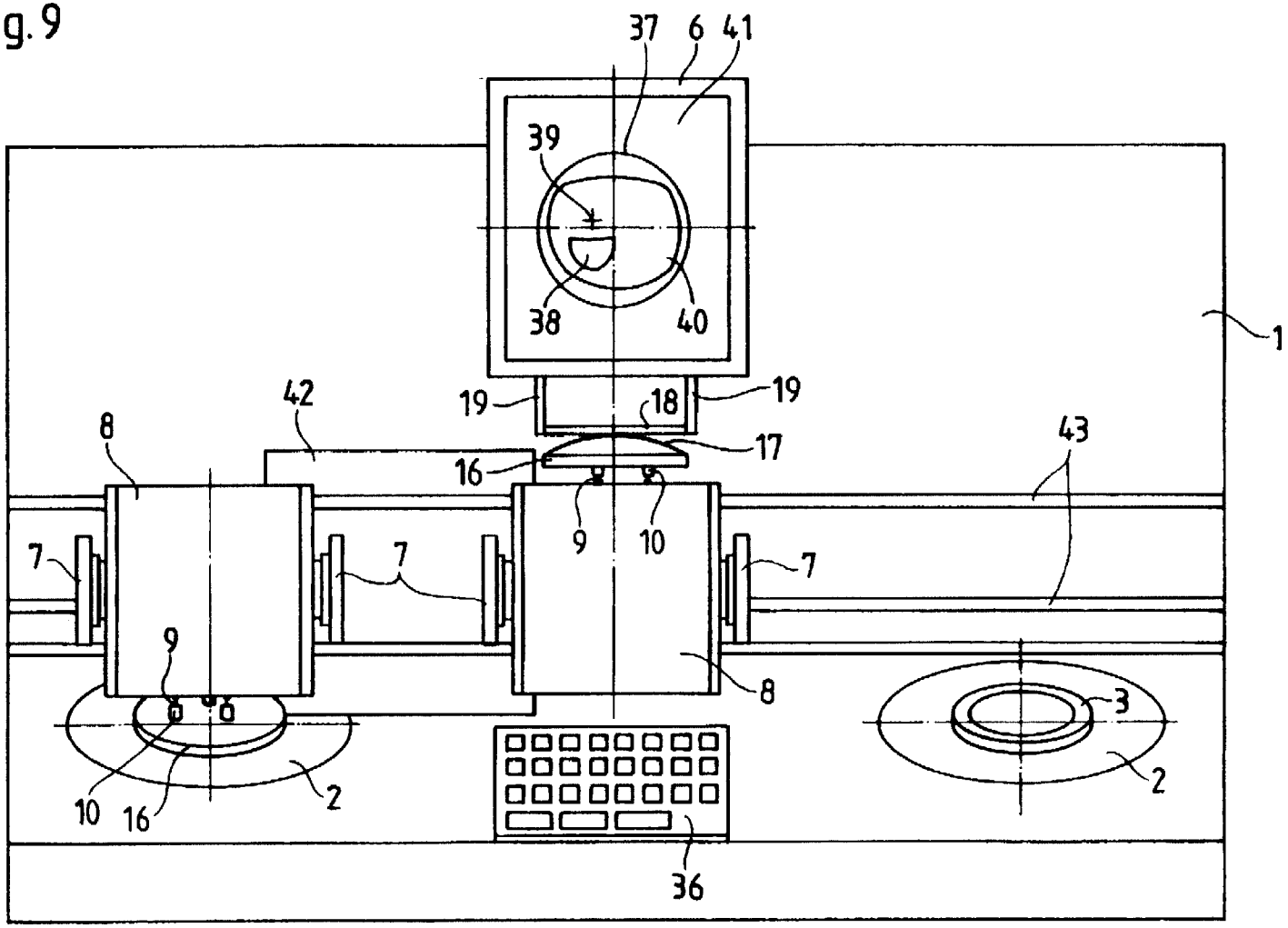
FIG. 9 shows a front view of a second embodiment of the device.
Figure 10:
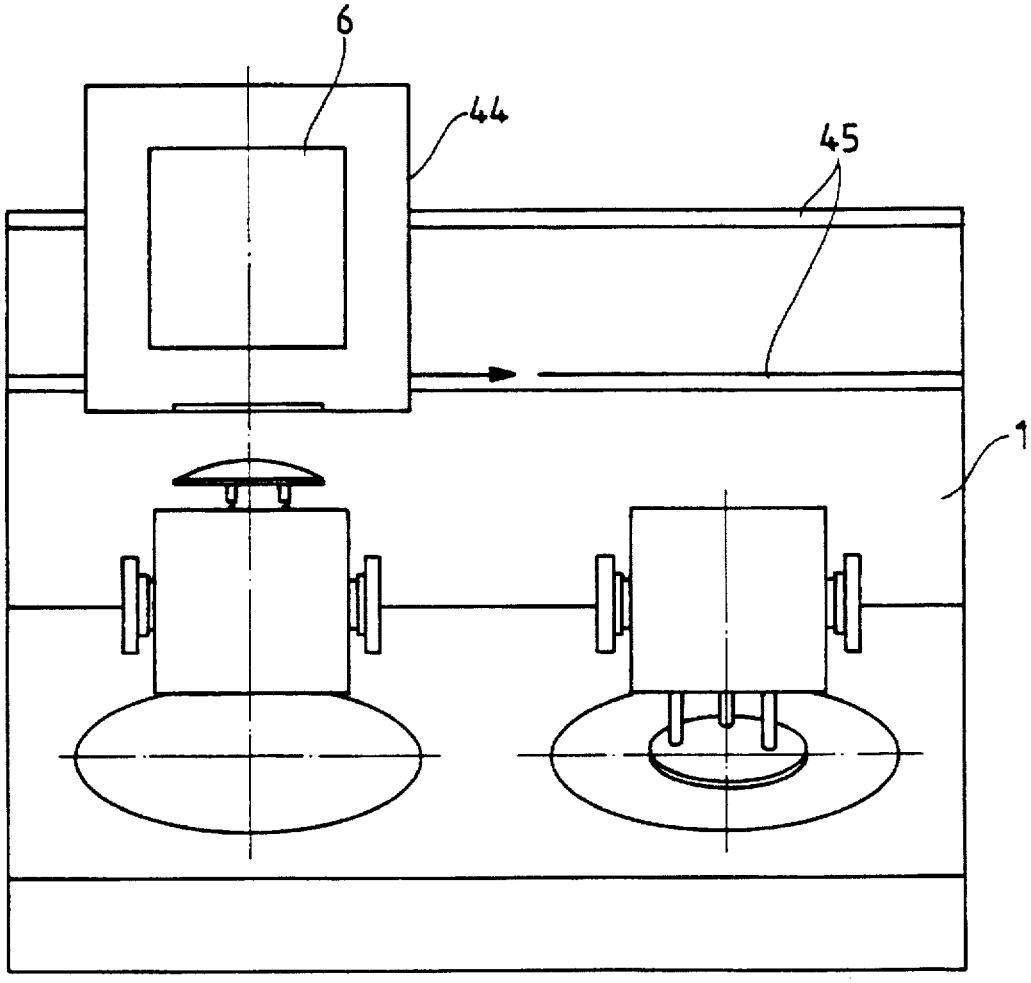
FIG. 10 shows a front view of a third embodiment of the device.

FIGS. 9 and 10 show two further embodiments of the device which have two block stations and two retaining devices 8, 9, 10 rather than one, but have only one viewing unit 6.

In the embodiment in FIG. 9, the retaining devices 8, 9, 10 are arranged on a common carriage 42 which can be moved transversely on guide rails 43. In the position represented, one retaining device 8, 9, 10 is located below the viewing unit 6, that is to say in the centering position, while the other retaining device 8, 9, 10 is located above one block station 2, that is to say in the position for mounting a retaining part. Thus, while one ophthalmic blank 16 is being aligned and centered in the centering position, another ophthalmic blank 16 is being held on the sealing ring 3 of the block station 2 and is being provided with a cast on retaining part.

The ophthalmic blank 16 placed onto the sealing ring 3 can be held in place by means of the device in FIG. 9 until the cast on retaining part has cooled down and solidified sufficiently in order to be removed from the mold. During this time, a second ophthalmic blank 16 can be aligned and centered in the centering position.

After termination of the mounting of the retaining part and of the alignment and centering, the two retaining devices 8, 9, 10 are displaced to the right by means of a motion drive acting on the carriage 42. This causes the aligned and centered ophthalmic blank 16 to be placed onto the sealing ring 3 of the second block station 2, enabling another ophthalmic blank 16 to be aligned and centered.

In this embodiment, the distance between the retaining devices 8, 9, 10 is half the distance between the two block stations 2, and the viewing unit 6 is arranged approximately centrally above the two block stations 2.

FIG. 10 shows two block stations 2 and over each of them there is a respective retaining device 8, 9, 10. However, these retaining devices 8, 9, 10 can only be pivoted and moved up and down, but cannot be moved transversely. Instead, the viewing unit 6 is arranged on a carriage 44 which can be moved to and fro along guide rails 45 on the carrier housing 1 and transversely between the two block stations 2. In this embodiment also, an ophthalmic blank 16 can be aligned and centered in the region of one block station, while a further ophthalmic blank 16 is lowered onto the sealing ring 3 of the second block station 2 where it is provided with a retaining part.

In all these embodiments, the block stations not only can be set up to cast on a retaining part, but can also have holders for prefabricated adhesive blocks or suckers onto which the aligned and centered ophthalmic blanks can be lowered and in this way connected thereto.

Furthermore, particularly for the embodiment of FIG. 9, it is possible to arrange the block stations 2 in the same plane as the stop ring 18 on the carrier housing 1. It is then not necessary to provide pivoting movement for the holding device 8, 9, 10, but only up and down movement.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A device for centering an ophthalmic blank and for mounting a retaining part on an optical surface of the blank, the device comprising:

a viewing unit including means enabling viewing of the ophthalmic blank when the blank is at the viewing unit;

a stop on the viewing unit against which the optical surface of the ophthalmic blank is to be placed for permitting parallax free viewing while the ophthalmic blank is being centered;

at least one movable retaining device including a bearing for supporting the ophthalmic blank;

at least one block station which is arranged in a plane out of a plane of the stop and on which the ophthalmic blank is positionable; and a motion drive connected with the retaining device for moving the bearing for applying the optical surface of the ophthalmic blank, which is held on the bearing of the retaining device from underneath against the stop into a centering position at the stop and also for moving the blank from the centering position into another position at the at least one block station, wherein the retaining device comprises a carrier including an illuminating system beneath the ophthalmic blank supported on the retaining device; guides in the carrier for the bearing for the ophthalmic blank; a ground glass screen and a condenser lens between the illuminating system and the ophthalmic blank supported on the bearing; and a locking device for the bearing.

2. The device of claim 1, wherein the block station is arranged in a plane selectively either above or below the movable retaining device, and the motion drive moves the retaining device for moving the ophthalmic blank to the block station.

3. The device of claim 1, wherein the motion drive moves the retaining device for placing the ophthalmic blank into a position selectively, which is either below or to the side of the centering position, where the ophthalmic blank is at the one block station.

4. The device of claim 1, further comprising block stations being at first and second positions on the device;

two of the retaining devices being arranged generally near to each other and coupled to be movable together over the device, such that one of the two retaining devices may be selectively moved into a centering position approximately midway between the first and second positions over the device while the other of the retaining devices is moved into a respective one of the first and second positions over the respective block station.

5. The device of claim 1, further comprising the bearing engaging the ophthalmic blank on one side thereof for moving the opposite side of the ophthalmic blank selectively against the stop and toward the block station.

6. The device of claim 1, wherein the retaining device comprises bearing pins with controllable suction heads connectible for holding a surface of the ophthalmic blank which is away from the optical surface.

7. The device of claim 1, further comprising a device for casting on a wax, plastic or metal alloy retaining part, the casting device being arranged for mounting the retaining part on the ophthalmic blank.

8. The device of claim 1, comprising two block stations displaced apart from each other on the device.

9. The device of claim 8, wherein at least one of the viewing units and the at least one retaining device is movable on the device to be generally at one or the other of the block stations, and the bearing on the at least one retaining device moving the blank between the stop and the respective block station at which the retaining device is located.

10. The device of claim 1, wherein the bearing includes bearing pins which are axially displaceable in a resilient manner.

11. The device of claim 1, wherein the retaining device is movable transversely over the device between a first position at the first of the block stations and a second different position.

12. The device of claim 11, wherein the second position of the retaining device is at the second of the block stations.

13. The device of claim 12, wherein the retaining device is alternately movable to one of the first and second positions; and a respective one of the viewing units arranged at each of the first and second positions.

14. The device of claim 12, wherein the one retaining device and the one viewing unit are coupled so as to be movable alternately into one of the first and second positions.

15. The device of claim 14, further comprising a common carriage on which the viewing unit, the stop thereof and the retaining device are arranged in positions respectively one above the other; the carriage being movable alternately to one or the other first and second positions.

16. The device of claim 15, wherein the retaining device includes axially parallel first guide rails, corresponding second guide rails on the device with which the first guide rails cooperate; means supporting the second guide rails for pivoting around a horizontal axis; the carriage including parallel retaining arms on which the second guide rails are supported for pivoting, whereby the retaining device is pivotable in orientation and is raiseable and lowerable between a centering position with an upwardly directed optical surface of the ophthalmic blank and a position for mounting the retaining part with an obliquely downwardly directed optical surface of the ophthalmic blank.

17. The device of claim 1, wherein the motion drive moves the retaining device to move the ophthalmic blank for laying the surface of the ophthalmic blank, which is to receive the retaining part, against the stop and for moving that surface of the blank into the position for mounting a retaining part.

18. The device of claim 17, wherein the motion drive further comprises a pivot drive for the retaining device for pivoting the retaining device to move the ophthalmic blank to an orientation to be moved against the stop or to an orientation toward the block station.

19. The device of claim 18, wherein the pivot drive comprises a horizontal axis about which the retaining device is pivotable.

20. The device of claim 17, wherein the retaining device comprises bearing pins with controllable suction heads connectible for holding a surface of the ophthalmic blank which is away from the optical surface.

21. The device of claim 17, further comprising a common carriage on which the viewing unit, the stop thereof and the retaining device are arranged in positions respectively one above the other; a carrier housing on which the carriage is mounted for transverse movement into the other positions thereof.

22. A device for centering an ophthalmic blank and for mounting a retaining part on an optical surface of the blank, the device comprising:

a viewing unit including means enabling viewing of the ophthalmic blank when the blank is at the viewing unit;

a stop on the viewing unit against which a surface of the ophthalmic blank is to be placed for permitting parallax free viewing while the ophthalmic blank is being centered;

at least two movable retaining devices, each including a respective bearing for supporting an ophthalmic blank; each retaining device being supported for being selectively movable up and down, toward and away from the stop;

a respective motion drive connected with each of the retaining devices for moving the respective bearing for applying the ophthalmic blank, which is held on the bearing against the stop of the viewing unit, when the viewing unit is in a centering position where it can receive the respective blank then on the retaining device, and the motion drive being operable for moving the retaining device for moving the blank from the centering position and into a position arranged below the centering position to a mounting position, wherein the viewing unit is movable transversely over the device and into the centering position.

23. The device of claim 22, wherein the motion drive further comprises a height adjustment drive connected with the viewing unit for moving the viewing unit for laying the optical surface of the ophthalmic blank against the stop on the viewing unit.

24. The device of claim 22, wherein the respective motion drive moves the retaining device to move the ophthalmic blank for laying the surface of the ophthalmic blank, which is to receive the retaining part, against the stop and for moving that surface of the blank into the position for mounting a retaining part.

25. The device of claim 24, further comprising a common carriage on which the viewing unit, the stop thereof and the retaining device are arranged in positions respectively one above the other; a carrier housing on which the carriage is mounted for transverse movement into the positions thereof.

26. The device of claim 24, further comprising a device for casting on a wax, plastic or metal alloy retaining part, the casting device being arranged for mounting the retaining part on the ophthalmic blank.

* * * * *